United States Patent [19]

Waples

[11] Patent Number: 4,842,331

[45] Date of Patent: Jun. 27, 1989

[54] HIGHCHAIR WITH ADJUSTABLE REMOVABLE TRAY FOR ONE-HAND OPERATION

[75] Inventor: David G. Waples, East Aurora, N.Y.

[73] Assignee: The Quaker Oats Company, Chicago, Ill.

[21] Appl. No.: 667,900

[22] Filed: Nov. 2, 1984

[51] Int. Cl.[4] ..... A47B 39/00

[52] U.S. Cl. ..... 297/149

[58] Field of Search ..... 297/149, 150, 151

[56] References Cited

U.S. PATENT DOCUMENTS

| | | | |
|---|---|---|---|
| 1,983,138 | 12/1934 | Lehman | 297/149 |
| 2,024,667 | 12/1935 | Stinson | 297/149 |
| 2,505,490 | 4/1950 | Greenbaum | 297/151 |
| 2,521,422 | 9/1950 | Strand, Jr. | 297/149 X |
| 2,799,324 | 7/1957 | Anderson | 297/150 X |
| 4,105,247 | 8/1978 | Saint | 297/149 |

FOREIGN PATENT DOCUMENTS

| | | | |
|---|---|---|---|
| 461807 | 12/1949 | Canada | 297/149 |
| 464806 | 4/1937 | United Kingdom | 297/149 |

*Primary Examiner*—Peter A. Aschenbrenner
*Attorney, Agent, or Firm*—Cumpston & Shaw

[57] ABSTRACT

A highchair and a companion tray have first and second latch means movable among three positions, a first position in which the tray may be completely removed from the chair, a second position in which the tray may be moved forward and backward, and a third position in which the tray is fixed in position on the chair. Release means are provided, operable with one hand, for moving the latch means between said second and third positions only.

15 Claims, 3 Drawing Sheets

HIGHCHAIR WITH ADJUSTABLE REMOVABLE TRAY FOR ONE-HAND OPERATION

This invention relates in general to children's highchairs, and more particularly to a highchair having a tray adapted for ease of installation and removal and particularly adapted for adjustment and removal with one hand.

It is advantageous in children's furniture that the operation of such furniture be as simple as possible so that those caring for the children, who may from time to time be uncooperative, can nevertheless use the furniture relatively easily.

Heretofore, highchairs with removable and/or adjustable trays have been known, but none have been available that allow the tray portion thereof to be installed, adjusted and removed all with one hand.

Highchairs are often used by young children who are likely to squirm or otherwise resist being placed on the chair, making it difficult to position and attach the tray. Because the side-mounted latches of trays heretofore known required two hands for simultaneous operation during installation and removal, it was difficult or impossible to operate the latches of the trays of prior art highchairs without releasing the child, who could then more readily attempt to remove himself from the chair even while the tray was being placed thereon or removed therefrom.

The adjustment of the trays on such known chairs is likewise complicated because two hands must be used, thereby making it necessary to set down whatever one might be carrying such as food for the child in order to adjust the tray. Further, in some prior art trays, the tray may be completely removed from the chair by the same action used to adjust it forward and backward, thus making it possible for the tray to be inadvertently removed during adjustment, either with or without the assistance of the child.

Accordingly, it is an object of this invention to provide a highchair having a companion tray that may be installed, removed, or adjusted with one hand.

It is another object of this invention to provide in combination a tray and highchair wherein the tray may be adjusted forward and backward using only one hand without the risk of accidentally releasing the tray from the highchair completely.

It is a further object of this invention to provide a combination highchair and tray that may be manufactured substantially entirely from molded plastic components thereby reducing the cost and increasing the durability of the tray compared with the prior art trays.

Briefly stated, and in accordance with a presently preferred embodiment of this invention, a highchair and companion tray are provided having first and second latch means movable among three positions, a first position in which the tray may be completely removed from the chair, a second position in which the tray may be moved forward and backward, and a third position in which the tray is fixed in position on the chair; and release means, operable with one hand, for moving the latch means between said second and third positions only.

The novel aspects of this invention are set forth with particularity in the appended claims. The invention itself, together with further objects and advantages thereof, may be more fully understood by reference to the following detailed description taken in connection with the accompanying drawing in which:

Figure 1:
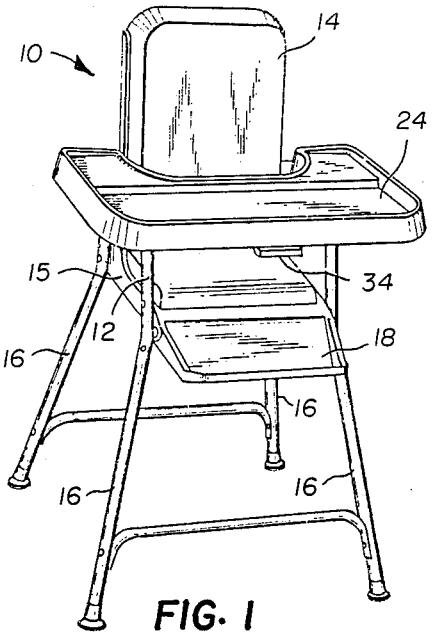
FIG. 1 is a perspective view of a highchair and tray in accordance with a presently preferred embodiment of the invention.
Figure 2:
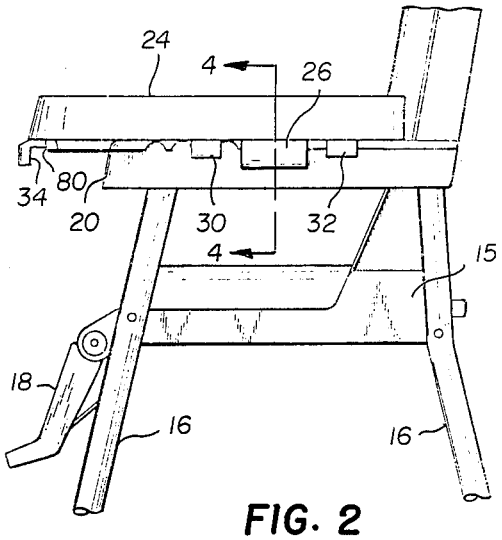
FIG. 2 is a side view of a portion of the highchair of FIG. 1.

Referring now to FIGS. 1 and 2, a highchair designated generally at 10 includes a seat 12 and a back 14 preferably pivotally attached to the seat by side brackets 15 for allowing chair 10 to be folded into a collapsed configuration for storage. A plurality of legs 16 supports the chair. Preferably, a foot rest 18 is attached to the front part of seat 12 for supporting the legs and/or feet of a child.

First and second arms 20 and 22 (not visible in FIG. 1) are attached to the legs and seat back on each side of the chair. Preferably, arms 20 and 22 are constructed of molded plastic.

A tray 24 is supported by the flat upper surfaces 42 (See FIG. 3) of arms 20 and 22 and is attached to arms 20 and 22 by first and second pivotally-mounted latches 26 and 28 (not visible). First, second and third positioning members 30, 32 and 33 depend downwardly from the underside of the tray 24 and engage the sides of arm 20 for guiding tray 24 along the arms. Similar positioning members, (not visible) engage arm 22 for laterally locating the tray on the arms of the chair while allowing sliding movement along the arms and vertical movement out of engagement with one or both arms.

An adjustment plunger 34 is located at the center forward edge of the tray for remotely actuating latches 26 and 28, respectively, as will be more fully described below.

Figure 3:
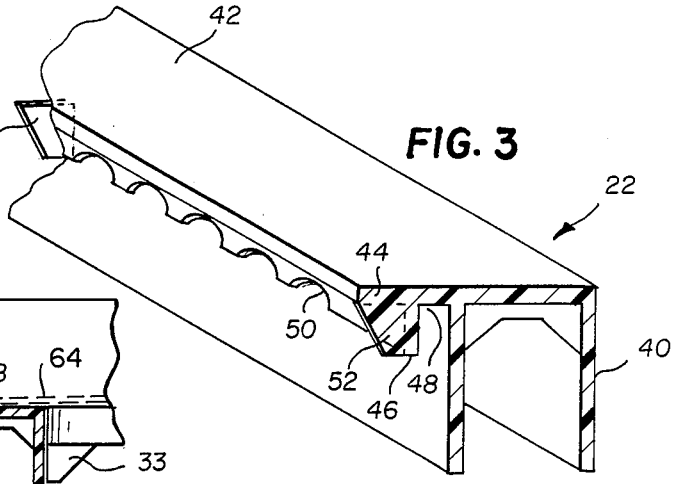
FIG. 3 is a cutaway perspective view of the arm portion of the chair.

Referring now to FIG. 3, a cross-section of arm 22 is illustrated. The arm comprises a generally rectangular inverted U-shaped main portion 40. Arm 22 has a flat upper surface 42 for supporting tray 24 and is open at the bottom.

Arm 22 includes an overhanging flange 44 extending laterally outwardly from upper surface 42 thereof and having a notched web 46 extending longitudinally along said arm parallel to the side wall of the U-shaped main portion and depending downwardly from the flange. Preferably, web 46 is stiffened with respect to body 40 and flange 44 by a plurality of supporting webs 48 disposed transversely to said arm at right angles to notched web 46 and located between notched web 46 and body 40. Web 46 includes a plurality of generally U-shaped notches 50 preferably evenly spaced along the length thereof for receiving a hook portion 56 of latch 26, as will be more fully described below. The range of adjustment of tray 24 on arms 20 and 22 is limited by stop members 52 and 54 disposed transversely of arms 22 and extending between the outer edge flange 44 and web 46. Stop members 52 and 54 are engaged by the side of hook portion 56 of latch 26 at the desired inward and outward limits of the travel of tray 24.

Figure 4B:
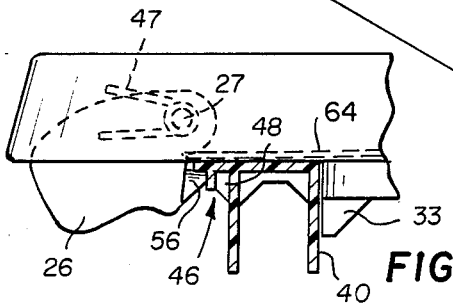
FIG. 4B is a sectional view similar to FIG. 4A showing the latch in a second position.
Figure 4C:
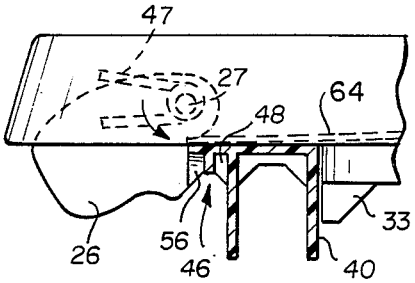
FIG. 4C is a sectional view similar to FIG. 4A showing the latch in a third position.
Figure 4A:
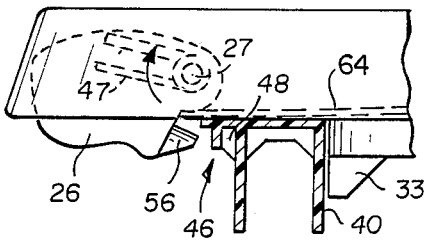
FIG. 4A is a sectional view of the latch portion of a highchair in accordance with the invention showing the same in a first position.

The cooperation of latch 26 and arm 22 may be appreciated by referring now to FIGS. 4A, 4B and 4C. FIGS. 4A, 4B and 4C are cross-sectional views taken along the corresponding lines of FIG. 2 and also including a section of latch 26 to show the manner of engagement of hook 56 with webs 46, 48 and 52, notches 50 and overhanging flange 44. Latch 26 is movable on pivot 27 between three operative positions, a first disengaged position shown in FIG. 4A, an adjustment position shown in FIG. 4B, and a latched position shown in FIG. 4C. Latch 26 is biased to the position shown in FIG. 4C by spring 47 or other convenient means.

Referring now to FIG. 4B, the adjustment position of latch 28 is shown in which hook 56 engages the underside of the outermost portion of flange 44, but does not extend inwardly beyond notched web 46 into notches 50. In this position, tray 24 may be slidably moved on the upper surfaces of the arms between the limits of travel established by stop members 52 and 54 which engage the sides of hook 56 thus preventing further movement. Latch 26 must be manually held in position during adjustment or hook 56 will, upon moving adjacent one of notches 50, be biased into engagement with notched web 46 by spring 47 thereby stopping the movement of tray 24. This is a useful adjustment feature, inasmuch as the tray may be readily moved one notch forward or backward by momentarily moving latch 26 to the adjustment position shown in FIG. 4B, displacing the tray slightly in the direction of the desired adjustment and releasing latches 26 which engage the side wall of web 46, but will, upon reaching alignment with the next notch, move into engagement with the notch as shown in FIG. 4B and secure the tray with respect to the arms of the highchair.

Figure 5:
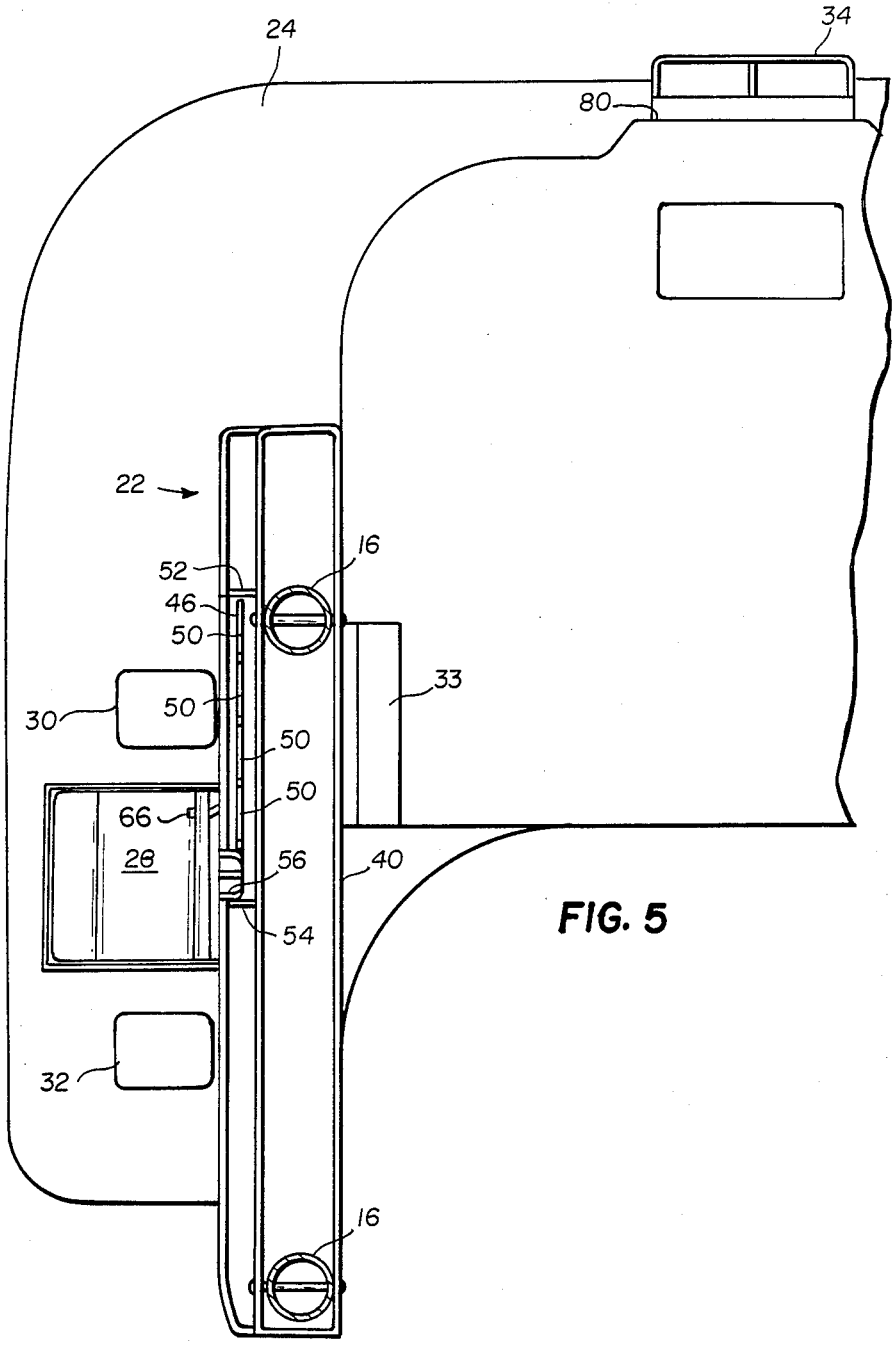
FIG. 5 is a bottom view of a portion of the arm and tray of a highchair in accordance with this invention.

Referring now to FIGS. 4C and 5, the latched position is shown. Hook 56 engages one of the notched portions 50 of web 46 and is restrained thereby from further movement. Preferably, latches 26 and 28 are urged towards the position illustrated in FIGS. 4C and 5 by spring 47 or other means imparting a like function.

The release position of latch 26 is shown in FIG. 4A. It will be seen that in the release position, hook 56 is retracted completely from beneath flange 44 and stops 52 and 54, and the tray 24 may be lifted vertically or moved horizontally forward to remove it from arms 20 and 22.

It is an additional feature of this invention that removal of tray 24 may be accomplished by manually retracting only a selected one of latches 26 and 28 to the position shown in FIG. 4A and pivoting the tray about the opposite arm to release the opposite latch without the necessity for the manual activation thereof. This allows one-handed removal and/or placement of the tray on the highchair.

Figure 6:
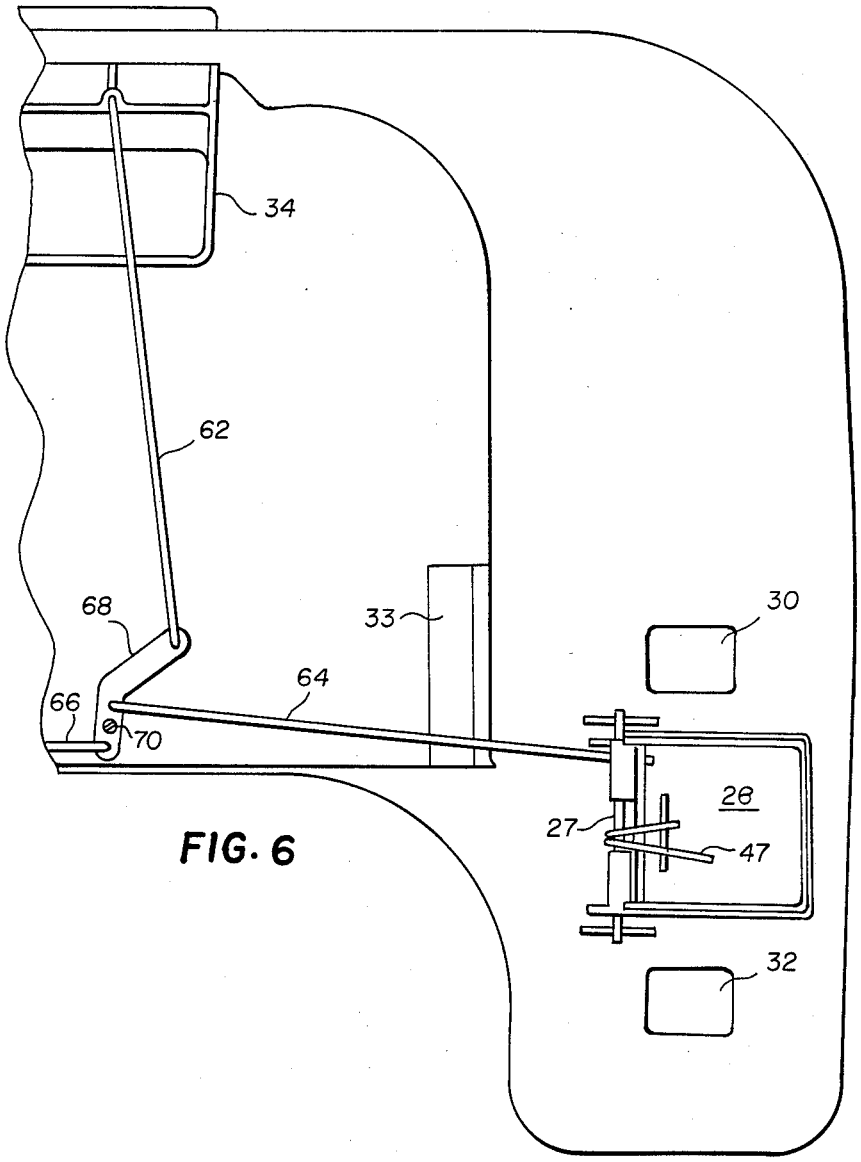
FIG. 6 is a cutaway view of the tray showing the linkage between the two latch elements and the adjustment control.

In accordance with a preferred embodiment of this invention as shown in FIG. 6, an adjustment plunger 34 is provided at the front portion of tray 24. Plunger 34 is manually operable with one hand and is operative to simultaneously move both of latches 26 and 28 to the adjustment position as shown in FIG. 4B whereby the tray may be adjusted forward and backward with respect to the chair, but may not be removed, nor positioned beyond the limits, defined by stops 52 and 54. Adjustment plunger 34 is connected to latches 26 and 28 by linkages 62, 64 and 66 and pivoting arm 68. Preferably, linkage 62 connects plunger 34 which is adapted for sliding motion as indicated by the arrow adjacent thereto, to pivotally mounted arm 68. Arm 68 is adapted to pivot around pivot post 70. Linkages 64 and 66 connect arm 68 to latches 26 and 28, respectively.

Adjustment plunger 34 is limited in the extent of its movement by a mechanical stop 80 that engages the L-shaped plunger so that in its extreme of movement, it moves latches 26 and 28 from the latched position shown in FIG. 4C only to the adjustment position shown in FIG. 4B and not to the release position shown in FIG. 4A. In this manner, the tray may be moved to the adjustment position without danger of inadvertent removal.

While the invention has been described in connection with a presently preferred embodiment thereof, those skilled in the art to which the invention pertains will recognize that certain modifications and changes may be made without departing from the true spirit and scope of the invention which is intended to be defined solely by the appended claims.

I claim:

1. In combination, a highchair and an adjustable removable tray comprising:

first and second arms having upper tray supporting surfaces;

a tray;

latch means on said tray movable among first, second and third positions, said first positions disengaging said tray from said arms; said second position allowing said tray to be moved on said arms, but not removed therefrom; and said third position holding said tray in a fixed position on said arms;

means on said arms for engaging said latch means to provide a plurality of fixed positions of said tray on said arms; and control means connected to said latch means and movable between first and second positions for moving said latch means between said second and third positions only.

2. The chair and tray of claim 1 wherein said latch means comprises first and second hooks movable among said first, second and third positions and adapted to engage said means on said arms.

3. The chair and tray of claim 2 wherein said means on said arms comprises a notched member attached to at least one of said arms, said notched member having a plurality of latch engaging notches for holding said tray when said latches are positioned in said third position.

4. The chair and tray of claim 2 further comprising stop means for engaging said hooks when said latches are in said second position for limiting the extent of movement of said tray on said arms.

5. The chair and tray of claim 1 wherein said control means for moving said latch means comprises plunger means mounted for operation with one hand and linkage means connected to said latch means and said plunger means for moving said latch means between said second and third positions in response to movement of said plunger means.

6. The chair and tray of claim 1 comprising means biasing said latch means to said third position.

7. The chair and tray of claim 6 wherein said means biasing said latch means comprises a spring.

8. The chair and tray of claim 1 wherein each of said first and second arms comprises a rectangular U-shaped body portion and an overhanging flange extending outwardly from said body portion.

9. The chair and tray of claim 8 wherein said means on said arms for engaging said latch comprises a notched web extending from said flange parallel to and spaced from said body portion.

10. The chair and tray of claim 9 further comprising stop means attached to said flange for engaging latch means in said second position for limiting the movement of said tray on said arms.

11. The chair and tray of claim 10 wherein said stop means comprises a member disposed between said arm and said flange perpendicular to said arms and said flange and adapted to engage said latch means in said second position.

12. A tray for attachment to a child's highchair comprising:

first and second latch means movable among three positions;

a first position in which said tray may be completely removed from said chair;

a second position in which said tray may be moved forward and backward on said chair, but not removed;

a third position in which said tray is fixed in position on said chair; and release means connected to said first and second latch means, for moving said latch means between said second and third positions only and not into or out of said first position.

13. The tray of claim 12 wherein said release means comprises means operable with one hand.

14. The tray of claim 12 wherein said release means comprises a plunger.

15. The tray of claim 14 comprising stop means engaging said plunger for limiting the movement thereof and preventing said latch means from moving to said first position when activated solely by said plunger.

* * * * *